US011980230B2

(12) United States Patent
Rogan et al.

(10) Patent No.: US 11,980,230 B2
(45) Date of Patent: May 14, 2024

(54) AEROSOL GENERATING DEVICE

(71) Applicant: JT International S.A., Geneva (CH)

(72) Inventors: Andrew Robert John Rogan, Forres (GB); Takashi Hasegawa, Tokyo (JP); Eduardo Jose Garcia Garcia, Grand-Sacconex (CH)

(73) Assignee: JT International S.A. (CH)

( * ) Notice: Subject to any disclaimer, the term of this patent is extended or adjusted under 35 U.S.C. 154(b) by 813 days.

(21) Appl. No.: 17/047,478

(22) PCT Filed: May 15, 2019

(86) PCT No.: PCT/EP2019/062478
§ 371 (c)(1),
(2) Date: Oct. 14, 2020

(87) PCT Pub. No.: WO2019/224069
PCT Pub. Date: Nov. 28, 2019

(65) Prior Publication Data

US 2021/0112872 A1 Apr. 22, 2021

(30) Foreign Application Priority Data

May 21, 2018 (EP) ..... 18173404

(51) Int. Cl.
*A24F 40/20* (2020.01)
*A24F 7/02* (2006.01)
(Continued)

(52) U.S. Cl.
CPC ..... *A24F 40/465* (2020.01); *A24F 7/02* (2013.01); *A24F 40/53* (2020.01); *A24F 40/20* (2020.01)

(58) Field of Classification Search
None
See application file for complete search history.

(56) References Cited

U.S. PATENT DOCUMENTS

2015/0027474 A1 1/2015 Zuber et al.
2015/0320116 A1* 11/2015 Bleloch ..... A24F 40/44 219/628
(Continued)

FOREIGN PATENT DOCUMENTS

CN 105340360 A 2/2016
CN 105595422 A 5/2016
(Continued)

OTHER PUBLICATIONS

Search Report dated Aug. 21, 2022 from the Office Action for Taiwanese Application No. 108116878 dated Aug. 24, 2022, 1 page.
(Continued)

*Primary Examiner* — Tho D Ta
(74) *Attorney, Agent, or Firm* — Lerner David LLP

(57) ABSTRACT

An aerosol generating device for heating an aerosol generating article to generate an aerosol for inhalation by a user includes an induction coil and a heating compartment arranged to receive an aerosol generating article. The device further includes a projecting element which projects into the heating compartment so that at least part of the projecting element is positioned inside an aerosol generating article received in the heating compartment, and at least part of the projecting element is inductively heatable in the presence of a time varying electromagnetic field.

13 Claims, 7 Drawing Sheets

(51) Int. Cl.
*A24F 40/465* (2020.01)
*A24F 40/53* (2020.01)

(56) References Cited

U.S. PATENT DOCUMENTS

| | | | | |
|---|---|---|---|---|
| 2016/0044962 | A1 | 2/2016 | Thorens et al. | |
| 2016/0309782 | A1 | 10/2016 | Malgat et al. | |
| 2017/0055580 | A1 | 3/2017 | Blandino et al. | |
| 2018/0029782 | A1* | 2/2018 | Zuber | H05B 1/0227 |
| 2018/0070639 | A1* | 3/2018 | Chen | F22B 1/281 |
| 2018/0325179 | A1 | 11/2018 | Li et al. | |

FOREIGN PATENT DOCUMENTS

| | | | | | |
|---|---|---|---|---|---|
| CN | 105852219 | A | | 8/2016 | |
| CN | 206025215 | U | | 3/2017 | |
| CN | 206603255 | U | | 11/2017 | |
| CN | 206808677 | U | | 12/2017 | |
| CN | 107772535 | A | | 3/2018 | |
| GB | 2554141 | A | * | 3/2018 | A24B 15/167 |
| JP | 2018529322 | A | | 10/2018 | |
| JP | 2019526232 | A | | 9/2019 | |
| KZ | 31603 | | | 9/2016 | |
| RU | 2609394 | C2 | | 2/2017 | |
| RU | 2665435 | C1 | | 8/2018 | |
| TW | 201717788 | A | | 6/2017 | |
| WO | 2017036950 | A2 | | 3/2017 | |
| WO | WO-2017068098 | A1 | * | 4/2017 | A24D 1/002 |
| WO | WO-2017068099 | A1 | * | 4/2017 | A24B 3/14 |
| WO | 2017207586 | A1 | | 12/2017 | |
| WO | 2018002085 | A1 | | 1/2018 | |
| WO | 2018019738 | A1 | | 2/2018 | |
| WO | 2018146071 | A1 | | 8/2018 | |

OTHER PUBLICATIONS

International Search Report and Written Opinion for Application No. PCT/EP2019/062478 dated Sep. 11, 2019, 14 pages.

Search Report dated Oct. 23, 2023 from the Office Action for Chinese Application No. 201980033611.7, pp. 1-2. [See p. 1, categorizing the cited references].

* cited by examiner

AEROSOL GENERATING DEVICE

CROSS-REFERENCE TO RELATED APPLICATIONS

The present application is a national phase entry under 35 U.S.C. § 371 of International Application No. PCT/EP2019/062478, filed May 15, 2019, published in English, which claims priority to European Application No. 18173404.7 filed May 21, 2018, the disclosures of which are incorporated herein by reference.

TECHNICAL FIELD

The present disclosure relates generally to an aerosol generating device, and more particularly to an aerosol generating device for heating an aerosol generating article to generate an aerosol for inhalation by a user. Embodiments of the present disclosure also relate to an aerosol generating system and to a kit of parts for aerosol generation.

TECHNICAL BACKGROUND

Devices which heat, rather than burn, an aerosol forming material to produce an aerosol for inhalation have become popular with consumers in recent years.

Such devices can use one of a number of different approaches to provide heat to the aerosol forming material. One such approach is to provide an aerosol generating device which employs an induction heating system and into which an aerosol generating article, comprising aerosol forming material, can be removably inserted by a user. In such a device, an induction coil is provided with the device and an induction heatable susceptor is also provided. Electrical energy is provided to the induction coil when a user activates the device which in turn generates an alternating electromagnetic field. The susceptor couples with the electromagnetic field and generates heat which is transferred, for example by conduction, to the aerosol forming material and an aerosol is generated as the aerosol forming material is heated.

Embodiments of the present disclosure seek to provide an improved user experience in which the characteristics of the aerosol are optimised.

SUMMARY OF THE DISCLOSURE

According to a first aspect of the present disclosure, there is provided an aerosol generating device for heating an aerosol generating article to generate an aerosol for inhalation by a user, the aerosol generating device comprising:

- an induction coil;
- a heating compartment arranged to receive an aerosol generating article; and
- a projecting element which projects into the heating compartment so that at least part of the projecting element is positioned inside an aerosol generating article received, in use, in the heating compartment;
- wherein at least part of the projecting element is inductively heatable in the presence of a time varying electromagnetic field.

The aerosol generating article comprises an aerosol forming material and the projecting element acts as an inductively heatable susceptor which heats the aerosol forming material, without burning the aerosol forming material, to volatise at least one component of the aerosol forming material and thereby generate an aerosol for inhalation by a user of the aerosol generating device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The projecting element acts as a reusable susceptor and is a separate component to the aerosol generating article rather than being integrated into the aerosol generating article at the time of manufacture. The aerosol generating article is thus easier and cheaper to manufacture than an aerosol generating article which incorporates one or more induction heatable susceptors integrated into the aerosol generating article. The risk of contamination, e.g., metal contamination, of the aerosol forming material by the induction heatable susceptor during storage is also eliminated or at least reduced because the induction heatable susceptor is brought into contact with the aerosol forming material only at the point of use, when an aerosol generating article is positioned in the heating compartment of the aerosol generating device.

The projecting element may be elongate. The projecting element may be removably mounted on the aerosol generating device. This allows the projecting element to be easily removed and replaced if it becomes soiled or contaminated, for example with deposits of aerosol forming material following a period of use.

The aerosol generating device may further comprise a device body including a controller.

The projecting element may be removably mounted on the device body.

The aerosol generating device may include a connector for removably mounting the projecting element. The provision of a connector allows for easy removable mounting of the projecting element and may advantageously ensure an appropriate positional relationship between the projecting element and the induction coil.

The aerosol generating device may further comprise a mouthpiece which is removably mounted on the device body and the mouthpiece may include the projecting element. Thus, removal and replacement of the projecting element on the device body may be carried out by removing and replacing the mouthpiece. This is advantageous as both the mouthpiece and the projecting element are elements that should be periodically replaced with approximately the same periodicity and providing for them both to be replaced at the same time is convenient for the user.

The projecting element may be arranged in the heating compartment so that a longitudinal axis of the projecting element is substantially aligned with a longitudinal axis of the induction coil. This positional relationship ensures optimum coupling of the electromagnetic field generated by induction coil with the projecting element.

The controller may be configured to detect the mounting of a projecting element on the aerosol generating device, for example on the device body. The controller may be configured to indicate a timing change of the projecting element (that is to indicate that it is time to change the projecting element or to indicate the remaining "life" of the projecting element before it should optimally be changed, etc.). For example, the controller may be configured to detect a predetermined power level supplied to the induction coil and to indicate a timing change of the projecting element based on the detected power level. In particular, the device can monitor the total energy supplied to the induction coil over time since inserting a new susceptor (by integrating the power supplied to the coil over time) and can determine that after a predetermined amount of energy has been supplied to the coil it is time for the susceptor to be changed. A notification that the susceptor should be changed can be provided to the user via any suitable means—e.g. by a warning light flashing in a predetermined pattern, etc.

The controller may be configured to detect the mounting of a new projecting element on the aerosol generating device. The controller may be configured to indicate a timing change of the projecting element after detecting the mounting of a new projecting element on the aerosol generating device, for example based on the detected power level. Alternatively or in addition, the controller may be configured to cease power supply to the induction coil after detecting the mounting of a new projecting element on the aerosol generating device and based on the detected power level. This arrangement ensures that the projecting element, i.e. the reusable susceptor, is replaced at appropriate time intervals to ensure optimum heating of aerosol generating articles used with the aerosol generating device.

In an embodiment, the controller may be configured to detect the mounting of a new projecting element on the aerosol generating device, for example on the device body, by detecting a characteristic associated with the projecting element. The characteristic could be an identification characteristic and could comprise an identification signal, for example emitted by a RFID tag associated with the projecting element. Alternatively, the user could indicate that the projecting element has been replaced with a new projecting element, e.g. by performing a predetermined action such as a button press or a series of button presses, etc.

The controller may be configured to detect the placement of an aerosol generating article in the heating compartment.

The controller may be configured to detect the consumption of aerosol forming material by detecting at least one of the following:

- the number of puffs;
- the length of the total puff period;
- the number of aerosol generating articles inserted into the heating compartment;
- the movement of one or more components of the aerosol generating device that are required to allow the placement of an aerosol generating article in the heating compartment.

Additionally it should be noted that the techniques for determining that a projecting element should be changed could generally also be used for detecting the amount of consumption of aerosol forming material and vice versa as will be apparent to a person skilled in the art.

The aerosol generating device may include a sensor, for example an optical sensor, to enable the controller to detect the number of aerosol generating articles inserted into the heating compartment.

The aerosol generating device may include one or more sensors to detect the movement of the one or more component parts, such as the projecting element, a mouthpiece or a cover to allow access to the heating compartment, to enable the controller to detect the movement of the one or more components of the aerosol generating device.

The controller may be configured to detect the level of consumption of aerosol forming material and to indicate a timing change of the projecting element based on the detected consumption level and/or to cease power supply to the induction coil based on the detected consumption level. The controller may be configured to detect the level of consumption of aerosol forming material after detecting the mounting of a new projecting element on the aerosol generating device. The controller may be further configured to indicate a timing change of the projecting element based on the detected consumption level after detecting the mounting of a new projecting element on the aerosol generating device and/or to cease power supply to the induction coil based on the detected consumption level after detecting the mounting of a new projecting element on the aerosol generating device and until the mounting of a new projecting element on the aerosol generating device is detected. Again, this arrangement ensures that the projecting element, i.e. the reusable susceptor, is replaced at appropriate time intervals to ensure optimum heating of aerosol generating articles used with the aerosol generating device.

The projecting element may be part of the device body.

The projecting element may include an air passage in communication with one or both of an air inlet and an air outlet of the aerosol generating device. This arrangement may advantageously improve the delivery of aerosol from the aerosol generating article.

The aerosol generating device may comprise a plurality of said projecting elements which may project into the heating compartment from opposite ends of the heating compartment. At least one of said plurality of projecting elements may be arranged at a first end of the heating compartment, for example on the mouthpiece or cover, and at least one of said plurality of projecting elements may be arranged at a second end of the heating compartment, for example on the device body. The provision of a plurality of projecting elements may advantageously improve the delivery of aerosol from the aerosol generating article even if the aerosol generating article is completely sealed before it is pierced by the projecting elements.

According to a second aspect of the present disclosure, there is provided an aerosol generating system for generating an aerosol for inhalation by a user, the aerosol generating system comprising:

- an aerosol generating device as defined above; and
- an aerosol generating article comprising a sealing member which is arranged to be broken by the projecting element during positioning of the aerosol generating article in the heating compartment.

Because the sealing member is broken at the point of use, for example due to piercing by the projecting element, a hermetically sealed aerosol generating article can be used without the need for additional packaging.

The aerosol generating article may comprise aerosol forming material which may define a cavity in which the projecting element is positioned. The cavity may comprise a hole in the aerosol forming material. The cavity may be positioned in a centre region of the aerosol generating article. With this arrangement, the cavity defines a space for receiving the projecting element. Thus, aerosol forming material is not substantially displaced by the projecting element during positioning of the aerosol generating article in the heating compartment and this may provide more uniform heating of the aerosol forming material.

The projecting element may be spaced from the aerosol forming material. By providing a gap between the surface of the projecting element and the aerosol forming material, delivery of aerosol from the aerosol generating article may be advantageously improved.

According to a third aspect of the present disclosure, there is provided a kit of parts comprising:

a plurality of aerosol generating articles each comprising aerosol forming material; and an element at least part of which is inductively heatable in the presence of a time varying electromagnetic field and adapted for use individually with the plurality of aerosol generating articles by being positioned next to the aerosol forming material to heat the aerosol forming material to thereby generate an aerosol for inhalation by a user.

The element may be adapted for removable mounting in an aerosol generating device, for example an aerosol generating device comprising an induction coil for inductively heating at least part of the element. The element may be adapted for removable mounting in a heating compartment of an aerosol generating device. The element does not form part of the aerosol generating device and can be removably mounted in the aerosol generating device with an aerosol generating article after being positioned next to the aerosol forming material of an aerosol generating article.

The element may be a projecting element and may be elongate. The element may be adapted for use individually with the plurality of aerosol generating articles by being positioned in the aerosol forming material.

The element acts as an induction heatable susceptor which is intended for use with all of the aerosol generating articles in the kit. The aerosol generating articles are, thus, easier and cheaper to manufacture than aerosol generating articles which incorporate one or more induction heatable susceptors integrated into each of the aerosol generating articles at the point of manufacture. The risk of contamination, e.g., metal contamination, of the aerosol forming material by the induction heatable susceptor during storage is also eliminated or at least reduced because the induction heatable susceptor is brought into contact with the aerosol forming material only at the point of use, when the element acting as the induction heatable susceptor is positioned next to the aerosol forming material.

The aerosol generating article may be elongate and may be substantially cylindrical. The cylindrical shape of the aerosol generating article with its circular cross-section may advantageously facilitate insertion of the aerosol generating article into the heating compartment of an aerosol generating device, in particular when the induction coil is a helical induction coil having a circular cross-section. The ability of the heating compartment to receive a substantially cylindrical aerosol generating article to be heated is advantageous as, often, vaporisable aerosol forming substances, and tobacco products in particular, are packaged and sold in a cylindrical form. It is also advantageous because induction heatable susceptors are also conveniently formed to have a cylindrical shape (e.g. forming a hollow, tubular cylinder) so as to provide efficient heating when inductively excited by the induction coil, and by forming the aerosol generating article also as a cylinder relatively uniform heating of the article can be conveniently achieved which provides good aerosol formation.

The induction coil may be arranged to operate in use with a fluctuating electromagnetic field having a magnetic flux density of between approximately 20 mT and approximately 2.0 T at the point of highest concentration.

The aerosol generating device may include a power source. The power source and the controller may be configured to operate at a high frequency. The power source and controller may be configured to operate at a frequency of between approximately 80 kHz and 500 kHz, possibly between approximately 150 kHz and 250 kHz, and possibly at approximately 200 kHz. The power source and circuitry could be configured to operate at a higher frequency, for example in the MHz range, depending on the type of inductively heatable susceptor that is used.

Whilst the induction coil may comprise any suitable material, typically the induction coil may comprise a Litz wire or a Litz cable.

Whilst the aerosol generating device may take any shape and form, it may be arranged to take substantially the form of the induction coil, to reduce excess material use. As noted above, the induction coil may be substantially helical in shape and may have a circular cross-section, thus the aerosol generating device may be substantially cylindrical and may have a substantially circular cross-section.

The circular cross-section of a helical induction coil facilitates the insertion of an aerosol generating article into the heating compartment and ensures uniform heating of the aerosol generating article. The resulting shape of the aerosol generating device is also comfortable for the user to hold.

The at least part of the projecting element that is inductively heatable may comprise one or more, but not limited, of aluminium, iron, nickel, stainless steel and alloys thereof, e.g. Nickel Chromium or Nickel Copper. With the application of an electromagnetic field in its vicinity, the at least part of the projecting element that is inductively heatable may generate heat due to eddy currents and/or magnetic hysteresis losses resulting in a conversion of energy from electromagnetic to heat.

The aerosol forming material may be any type of solid or semi-solid material. Example types of aerosol forming solids include powder, granules, pellets, shreds, strands, particles, gel, strips, loose leaves, cut filler, porous material, foam material or sheets. The aerosol forming material may comprise plant derived material and in particular, may comprise tobacco.

The aerosol forming material may comprise an aerosol-former. Examples of aerosol-formers include polyhydric alcohols and mixtures thereof such as glycerine or propylene glycol. Typically, the aerosol forming material may comprise an aerosol-former content of between approximately 5% and approximately 50% on a dry weight basis. In some embodiments, the aerosol forming material may comprise an aerosol-former content of approximately 15% on a dry weight basis.

Upon heating, the aerosol forming material may release volatile compounds. The volatile compounds may include nicotine or flavour compounds such as tobacco flavouring.

DETAILED DESCRIPTION OF EMBODIMENTS

Embodiments of the present disclosure will now be described by way of example only and with reference to the accompanying drawings.

Figure 1:
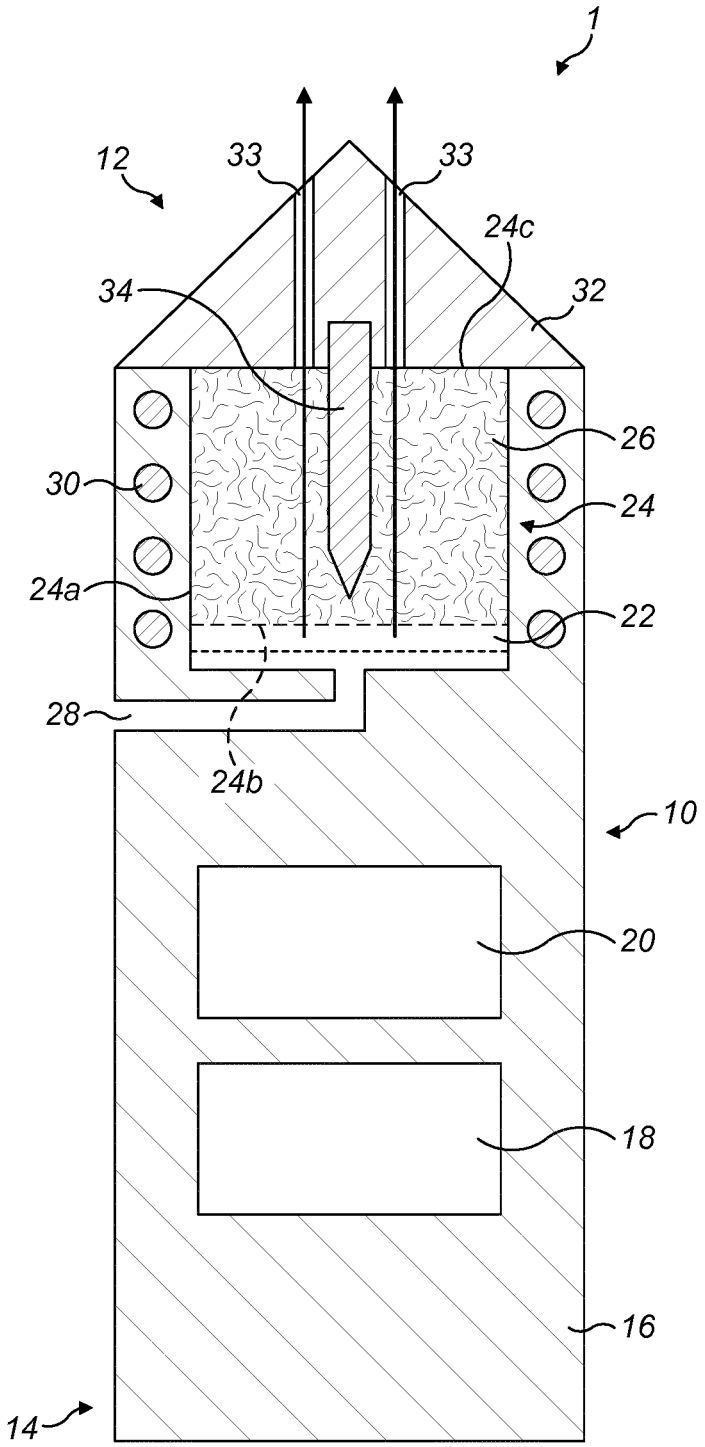
FIG. 1 is a diagrammatic cross-sectional view of a first embodiment of an aerosol generating system having a heating compartment located at its proximal end.

Referring initially to FIG. 1, there is shown diagrammatically a first embodiment of an aerosol generating system 1. The aerosol generating system 1 comprises an aerosol generating device 10 and an aerosol generating article 24. The aerosol generating device 10 has a proximal end 12 and a distal end 14 and comprises a device body 16 which includes a power source 18 and a controller 20 which may be configured to operate at high frequency. The power source 18 typically comprises one or more batteries which could, for example, be inductively rechargeable.

The aerosol generating device 10 comprises a generally cylindrical heating compartment 22 at the proximal end 12 which is arranged to receive a correspondingly shaped generally cylindrical aerosol generating article 24 containing an aerosol forming material 26. The aerosol generating article 24 comprises a non-metallic cylindrical outer shell 24*a*, an air-permeable layer or membrane 24*b* at the distal end and an impermeable sealing layer 24*c* at the proximal end. The aerosol generating article 24 is a disposable article 24 which may, for example, contain tobacco as the aerosol forming material 26. The aerosol generating device 10 includes an air inlet 28 to deliver air to the heating compartment 22.

The aerosol generating device 10 comprises a helical induction coil 30 which has a circular cross-section and which extends around the cylindrical heating compartment 22. The induction coil 30 can be energised by the power source 18 and controller 20. The controller 20 includes, amongst other electronic components, an inverter which is arranged to convert a direct current from the power source 18 into an alternating high-frequency current for the induction coil 30.

The aerosol generating device 10 comprises a mouthpiece 32 which is removably mountable on the device body 16 at the proximal end 12 and through which a user may inhale vapour generated during use of the device 10. The mouthpiece 32, which is shown diagrammatically in FIG. 1, includes one or more air outlets 33 which allow aerosol generated during use of the device 10 to flow from the heating compartment 22 and into the mouth of a user.

The mouthpiece 32 includes a projecting element 34 which projects into the heating compartment 22 when the mouthpiece 32 is mounted on the device body 16 as shown schematically in FIG. 1. The projecting element 34 is elongate and has a tapered end which is suitable for breaking the sealing layer 24*c* of the aerosol generating article 24. More particularly, the tapered end is adapted to pierce the sealing layer 24*c* of an aerosol generating article 24 that has been positioned in the heating compartment 22 thereby allowing air to flow from the heating compartment 22 through the air outlets 33 in the mouthpiece 32. When the mouthpiece 32 is mounted on the device body 16 at the proximal end 12 of the device 10, the projecting element 34 penetrates and extends into the aerosol forming material 26 such that the surface of the projecting element 34 contacts the aerosol forming material 26 adjacent to it.

At least part of the projecting element 34, and possibly the whole of the projecting element 34, comprises an inductively heatable susceptor material. Thus, when the induction coil 30 is energised by the alternating high-frequency current, an alternating and time-varying electromagnetic field is produced. This couples with the inductively heatable susceptor material of the projecting element 34 and generates eddy currents and/or hysteresis losses in the inductively heatable susceptor material causing it to heat up. The heat is then transferred from the inductively heatable susceptor material to the aerosol forming material 26, for example by conduction, radiation and convection.

The heat transferred from the inductively heatable susceptor material of the projecting element 34 to the aerosol forming material 26 causes it to heat up and thereby produce an aerosol. The aerosolisation of the aerosol forming material 26 is facilitated by the addition of air from the surrounding environment through the air inlet 28 which flows through the air-permeable layer 24*b* and through the aerosol forming material 26. The aerosol generated by heating the aerosol forming material 26 then exits the heating compartment 22, through the opening in the sealing layer 24*c* created by piercing with the projecting element 34 and through the air outlets 33, and is inhaled by a user of the device 10 through the mouthpiece 32. It will be understood that the flow of air through the heating compartment 22, i.e. from the air inlet 28, through the heating compartment 22 and out of the air outlets 33 in the mouthpiece 32, can be aided by negative pressure created by a user drawing air from the outlet side of the device 10 using the mouthpiece 32.

In some embodiments, the controller 20 can be configured to detect the mounting of a new projecting element 34 in the heating compartment 22, for example by detecting an identification characteristic associated with the projecting element 34. After detecting the mounting of a new projecting element 34, the controller 20 can be further configured to detect the power level supplied to the induction coil 30 and to indicate a timing change of the projecting element 34 based on the detected power level and/or to cease power supply to the induction coil 30 based on the detected power level until the controller 20 detects that another new projecting element 34 has been positioned in the heating compartment 22.

In some embodiments, the controller 20 can be configured to detect the consumption of aerosol forming material 26 by detecting one or more of: the number of puffs; the length of the total puff period; the number of aerosol generating articles 24 inserted into the heating compartment 22, for example using an optical sensor (not shown); and the movement of one or more components of the aerosol generating device 10, for example the movement of the mouthpiece 32, that are required to allow the placement of an aerosol generating article 24 in the heating compartment 22.

In some embodiments, the controller 20 can advantageously be configured to detect the level of consumption of aerosol forming material 26 after detecting the positioning of a new projecting element 34 in the heating compartment 22, and can be configured to indicate a timing change of the projecting element 34 based on the detected consumption level and/or to cease power supply to the induction coil 30 based on the detected consumption level until the controller 20 detects that another new projecting element 34 has been positioned in the heating compartment 22.

Figure 2:
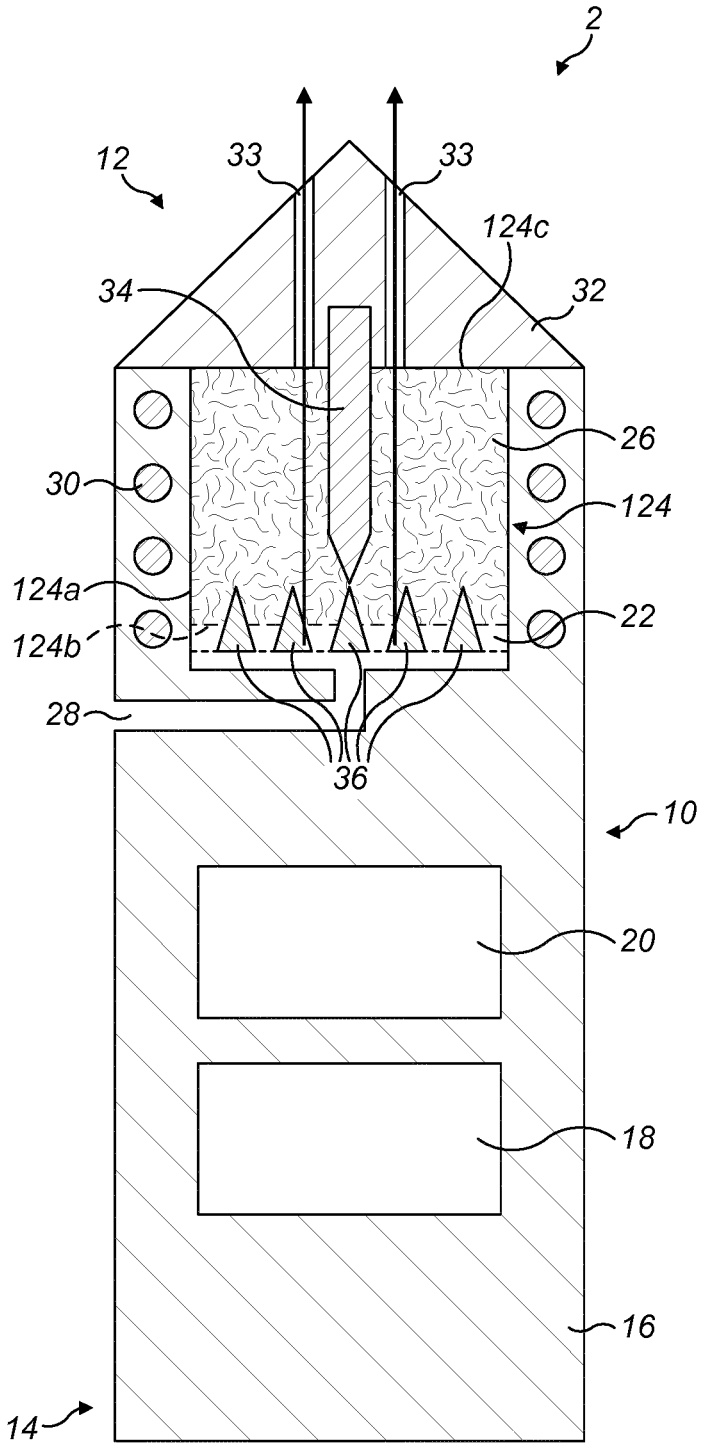
FIG. 2 is a diagrammatic cross-sectional view of a second embodiment of an aerosol generating system similar to the first embodiment shown in FIG. 1.

Referring now to FIG. 2, there is shown diagrammatically a second embodiment of an aerosol generating system 2 which is similar to the aerosol generating system 1 illustrated in FIG. 1 and in which corresponding elements are designated using the same reference numerals.

In addition to the projecting element 34 that extends in use from the mouthpiece 32 into the heating compartment 22 at its proximal end, the aerosol generating device 10 includes a plurality of further projecting elements 36 which project into the heating compartment 22 at its distal end. At least part, and possibly the whole, of one or more of the further projecting elements 36 comprise an inductively heatable susceptor material. In some embodiments, at least part, and possibly the whole, of all of the further projecting elements 36 comprise an inductively heatable susceptor material.

The aerosol generating article 124 of this second embodiment comprises a non-metallic cylindrical outer shell 124*a*, an impermeable sealing layer 124*b* at the distal end and an impermeable sealing layer 124*c* at the proximal end. The aerosol generating article 124 is, thus, fully sealed by the impermeable sealing layers 124*b*, 124*c* and the non-metallic outer shell 124*a* prior to being positioned in the heating compartment 22. When the mouthpiece 32 is mounted onto the device body 16 at the proximal end 12 of the device 10, the projecting element 34 pierces the sealing layer 124*c* of an aerosol generating article 124 that has been positioned in the heating compartment 22 thereby allowing air to flow from the heating compartment 22 through the air outlets 33 in the mouthpiece 32. In addition, a force is applied to the aerosol generating article 124 during mounting of the mouthpiece 32 (e.g. from a downward facing abutment surface of the mouthpiece 32 in which the projecting element is embedded) and this causes the further projecting elements 36 to pierce the sealing layer 124*b*, thereby permitting air to flow into the aerosol generating article 124 and through the aerosol forming material 26.

When the induction coil 30 is energised by the alternating high-frequency current, an alternating and time-varying electromagnetic field is produced. This couples with the inductively heatable susceptor material of the projecting element 34 and the further projecting elements 36 and generates eddy currents and/or hysteresis losses in the inductively heatable susceptor material causing it to heat up. The heat is then transferred from the inductively heatable susceptor material to the aerosol forming material 26, for example by conduction, radiation and convection.

The heat transferred from the inductively heatable susceptor material of the projecting element 34 and the further projecting elements 36 to the aerosol forming material 26 causes it to heat up and thereby produce an aerosol. The aerosolisation of the aerosol forming material 26 is facilitated by the addition of air from the surrounding environment through the air inlet 28 which flows through the pierced sealing layer 124*b* into the aerosol generating article 124 and through the aerosol forming material 26. The aerosol generated by heating the aerosol forming material 26 then exits the heating compartment 22, through the opening in the sealing layer 124*c* created by piercing with the projecting element 34 and through the air outlets 33, and is inhaled by a user of the device 10 through the mouthpiece 32 in the manner described above.

Figure 3:
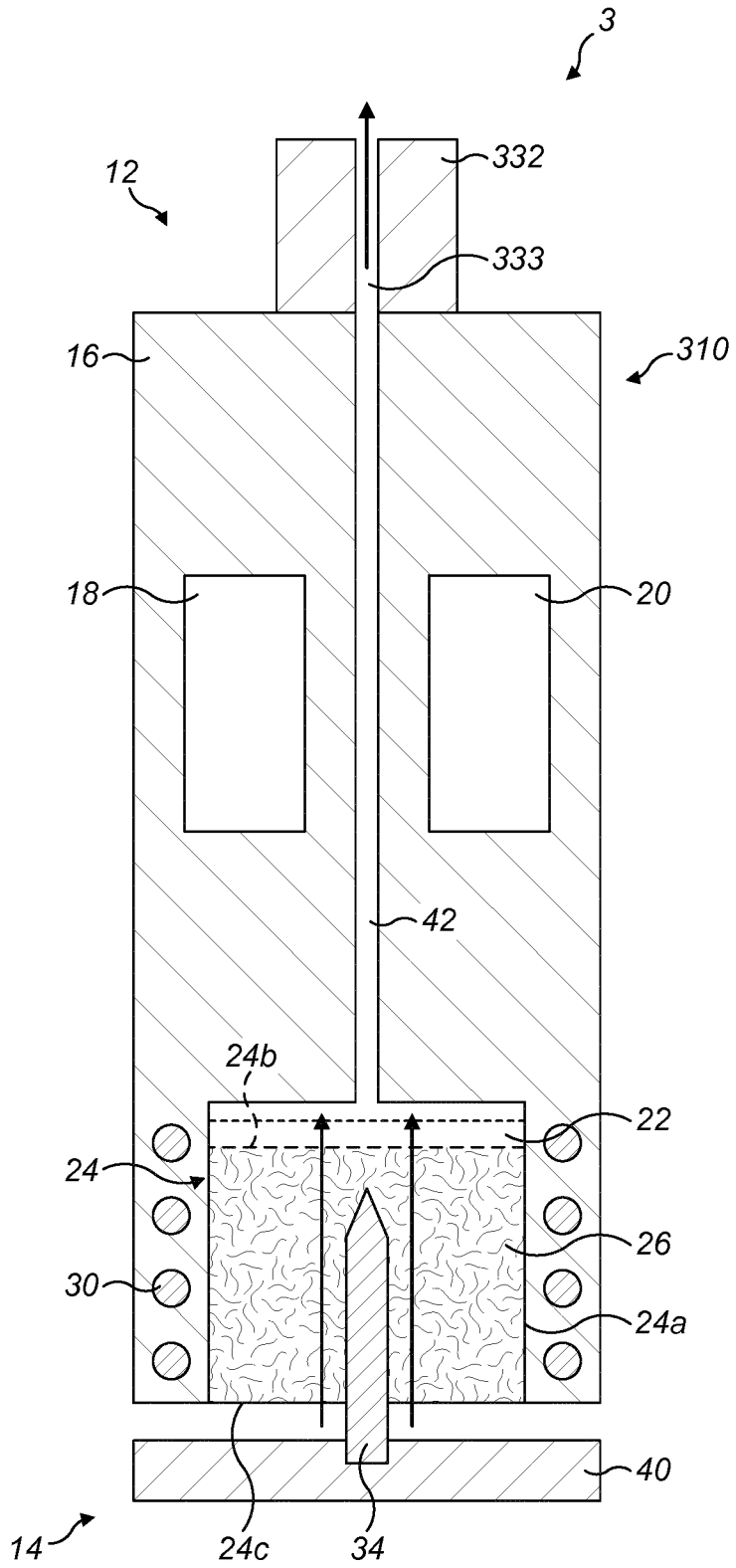
FIG. 3 is a diagrammatic cross-sectional view of part of a third embodiment of an aerosol generating system having a heating compartment located at its distal end.

Referring now to FIG. 3, there is shown diagrammatically a third embodiment of an aerosol generating system 3 which is similar to the aerosol generating system 1 illustrated in FIG. 1 and in which corresponding elements are designated using the same reference numerals.

The aerosol generating system 3 comprises an aerosol generating device 310 having an integrally formed mouthpiece 332 at the proximal end 12 of the device 310 and in which the heating compartment 22 is located at the distal end 14 of the device 310. A cover 40 for the heating compartment 22 is removably mountable on the device body 16 at the distal end 14. The cover 40 includes a projecting element 34 which projects into the heating compartment 22 when the cover 40 is mounted on the device body 16 as shown schematically in FIG. 3. The projecting element 34 is the same as the projecting element 34 described above in connection with FIG. 1. The cover 40 may also include one or more air inlets (not shown) to allow air to flow into the heating compartment 22.

The aerosol generating article 24 is also as described above in connection with FIG. 1 but is shown in an inverted orientation in FIG. 3. The aerosol generating article 24 thus comprises a non-metallic cylindrical outer shell 24*a*, an air-permeable layer or membrane 24*b* at the proximal end and an impermeable sealing layer 24*c* at the distal end. It will be understood that when the cover 40 is mounted on the device body 16 at the distal end 14 of the device 310, the projecting element 34 penetrates and extends into the aerosol forming material 26 such that the surface of the projecting element 34 contacts the aerosol forming material 26.

The operation of the aerosol generating system 3 is similar to the operation of the aerosol generating system 1 described above in connection with FIG. 1. Thus, when the induction coil 30 is energised by the alternating high-frequency current, an alternating and time-varying electromagnetic field is produced. This couples with the inductively heatable susceptor material of the projecting element 34 and generates eddy currents and/or hysteresis losses in the inductively heatable susceptor material causing it to heat up. The heat is then transferred from the inductively heatable susceptor material to the aerosol forming material 26, for example by conduction, radiation and convection.

The heat transferred from the inductively heatable susceptor material of the projecting element 34 to the aerosol forming material 26 causes it to heat up and thereby produce an aerosol. The aerosolisation of the aerosol forming material 26 is facilitated by the addition of air from the surrounding environment which flows through the pierced sealing layer 24*c* and through the aerosol forming material 26. The aerosol generated by heating the aerosol forming material 26 then exits the heating compartment 22 through the air-permeable layer 24*b*, along passage 42 and through the air outlet 333 where it is inhaled by a user of the device 310 through the mouthpiece 332. It will be understood that the flow of air through the heating compartment 22 can be aided by negative pressure created by a user drawing air from the outlet side of the device 310 using the mouthpiece 332.

Figure 4:
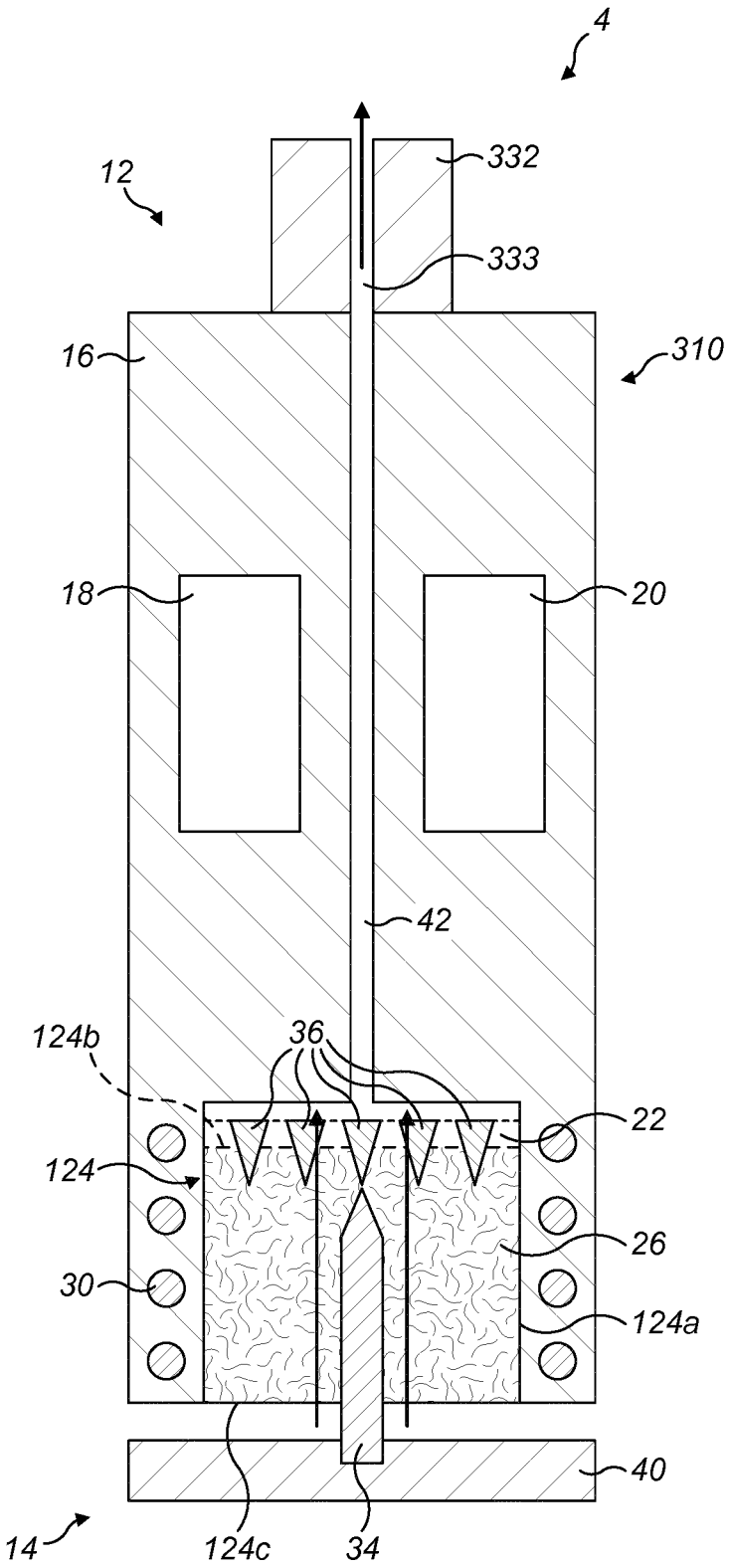
FIG. 4 is a diagrammatic cross-sectional view of part of a fourth embodiment of an aerosol generating system similar to the third embodiment shown in FIG. 3.

Referring now to FIG. 4, there is shown diagrammatically a fourth embodiment of an aerosol generating system 4 which is similar to the aerosol generating system 3 illustrated in FIG. 3 and in which corresponding elements are designated using the same reference numerals.

In addition to the projecting element 34 that extends in use from the cover 40 into the heating compartment 22 at its distal end, the aerosol generating device 310 includes a plurality of further projecting elements 36 which project into the heating compartment 22 at its proximal end. The further projecting elements 36 are as described above in connection with FIG. 2.

The aerosol generating article 124 is also as described above in connection with FIG. 2 but is shown in an inverted orientation in FIG. 4. The aerosol generating article 124 comprises a non-metallic cylindrical outer shell 124*a*, an impermeable sealing layer 124*b* at the proximal end and an impermeable sealing layer 124*c* at the distal end. The aerosol generating article 124 is, thus, fully sealed by the impermeable sealing layers 124*b*, 124*c* and the non-metallic shell 124*a* prior to being positioned in the heating compartment 22. When the cover 40 is mounted onto the device body 16 at the distal end 14 of the device 310, the projecting element 34 pierces the sealing layer 124*c* of an aerosol generating article 124 that has been positioned in the heating compartment 22, thereby allowing air to flow into the heating compartment 22. In addition, a force is applied to the aerosol generating article 124 during mounting of the cover 40 and this causes the further projecting elements 36 to pierce the sealing layer 124*b*, thereby permitting air to flow out of the heating compartment 22 and along the passage 42.

The operation of the aerosol generating system 4 is similar to the operation of the aerosol generating system 3 described above. Thus, when the induction coil 30 is energised by the alternating high-frequency current, an alternating and time-varying electromagnetic field is produced. This couples with the inductively heatable susceptor material of the projecting element 34 and the further projecting elements 36 and generates eddy currents and/or hysteresis losses in the inductively heatable susceptor material causing it to heat up. The heat is then transferred from the inductively heatable susceptor material to the aerosol forming material 26, for example by conduction, radiation and convection.

The heat transferred from the inductively heatable susceptor material of the projecting element 34 and the further projecting elements 36 to the aerosol forming material 26 causes it to heat up and thereby produce an aerosol. The aerosolisation of the aerosol forming material 26 is facilitated by the addition of air from the surrounding environment which flows through the pierced sealing layer 124*c* and through the aerosol forming material 26. The aerosol generated by heating the aerosol forming material 26 then exits the heating compartment 22 through the pierced sealing layer 124*b*, along passage 42 and through the air outlet 333 where it is inhaled by a user of the device 310 through the mouthpiece 332. It will be understood that the flow of air through the heating compartment 22 can be aided by negative pressure created by a user drawing air from the outlet side of the device 310 using the mouthpiece 332.

Figure 5A:
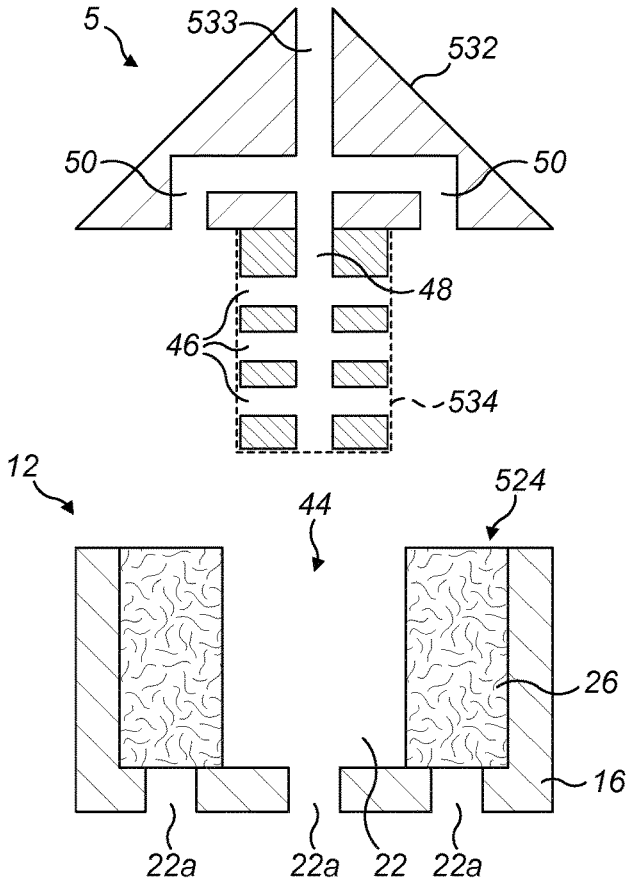
FIG. 5*a* is a diagrammatic cross-sectional view of part of a fifth embodiment of an aerosol generating system similar to the first embodiment shown in FIG. 1 and prior to attachment of a mouthpiece.
Figure 5B:
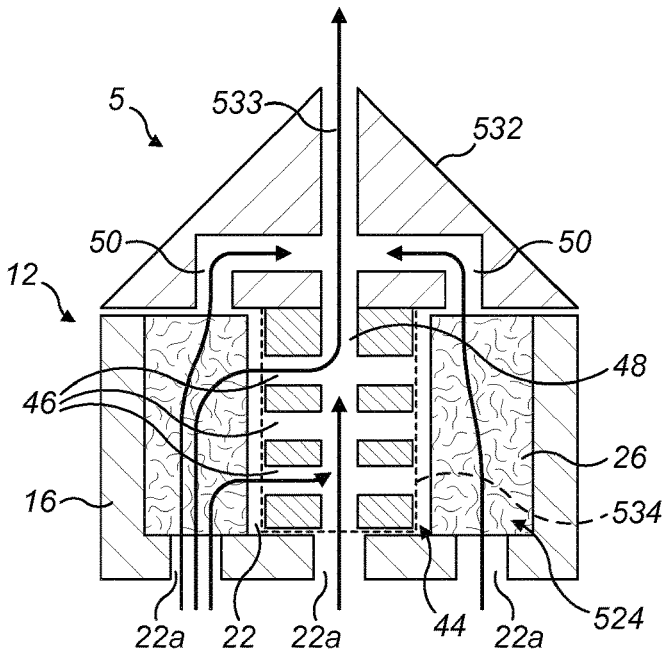
FIG. 5*b* is a diagrammatic cross-sectional view of part of the aerosol generating system shown in FIG. 5*a* after attachment of the mouthpiece and indicating airflow through the device.

Referring now to FIGS. 5*a* and 5*b*, there is shown diagrammatically part of a fifth embodiment of an aerosol generating system 5 which is similar to the aerosol generating system 1 illustrated in FIG. 1 and in which corresponding elements are designated using the same reference numerals.

The aerosol generating system 5 comprises a generally annular cylindrical aerosol generating article 524 comprising a cylindrical body of aerosol forming material 26 which is formed to include a cavity 44. The cylindrical annular aerosol generating article 524 is shown in FIG. 5*a* positioned in the heating compartment 22 at the proximal end 12 of an aerosol generating device. The aerosol generating device is similar to the aerosol generating device 10 described above with reference to FIG. 1 and comprises a plurality of air inlets 22*a* which direct air into the heating compartment 22 as shown in FIG. 5*b*.

The aerosol generating device comprises a mouthpiece 532 with a projecting element 534 that is positioned in the cavity 44 when the mouthpiece 532 is mounted on the device body 16 at the proximal end 12 of the aerosol generating device. In the illustrated embodiment, the outer diameter of the projecting element 534 is smaller than the inner diameter of the body of aerosol forming material 26 so that the circumferentially and axially extending outer surface of the projecting element 534 is spaced from (an internal or inner cylindrical surface of) the aerosol forming material 26 without contacting it, as clearly shown in FIG. 5*b*. In other embodiments (not illustrated), the outer diameter of the projecting element 534 could be substantially equal to the inner diameter of the body of aerosol forming material 26 so that the outer surface of the projecting element 534 contacts the adjacent inner surface of the aerosol forming material 26 when the projecting element 534 is positioned in the cavity 44.

The projecting element 534 comprises a plurality of radially extending air passages 46 and a longitudinal air passage 48. The passages 46, 48 promote the flow of air through the air inlets 22*a* into and through the heating compartment 22 of the aerosol generating device and promote the flow of aerosol generated by heating the aerosol forming material 26 into air passages 50 formed in the mouthpiece 532 and through the air outlet 533 as shown schematically by the arrows in FIG. 5*b*.

Figure 6:
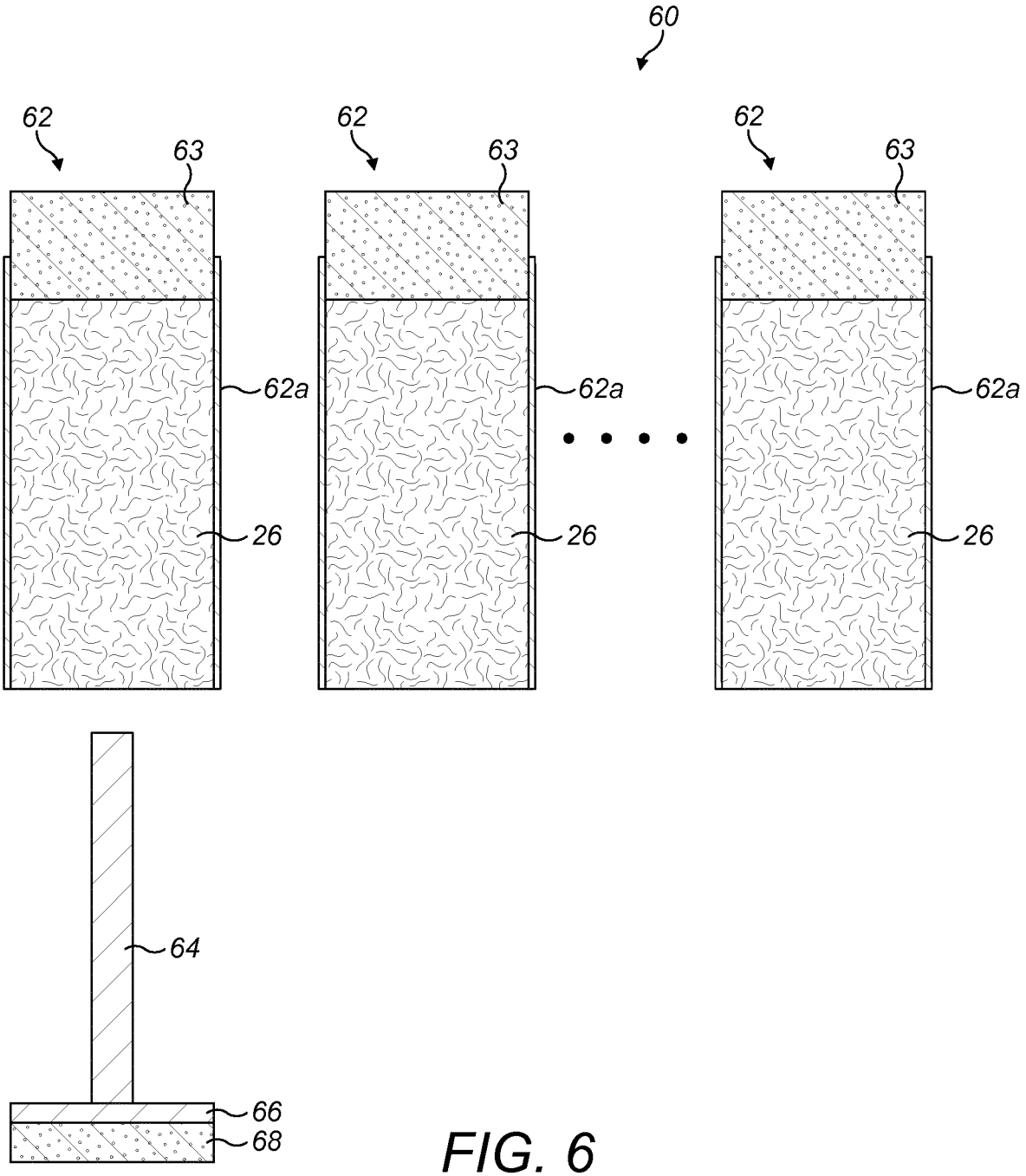
FIG. 6 is a diagrammatic illustration of a kit of parts for aerosol generation.

Referring now to FIG. 6, there is shown a kit of parts 60 for aerosol generation which comprises a plurality of aerosol generating articles 62, for example twenty aerosol generating articles 62. Each aerosol generating article 62 comprises a body of aerosol forming material 26 surrounded by a non-metallic cylindrical outer shell 62*a*, for example a paper wrapper. Each aerosol generating article 62 further comprises an air-permeable plug 63, for example comprising cellulose acetate fibres, at an axial end thereof.

The kit 60 further includes an element 64 which in the illustrated embodiment is elongate. At least part of the elongate element 64, and possibly the whole of the elongate element 64, comprises an inductively heatable susceptor material as described above with reference to FIG. 1. The elongate element 64 extends from a metallic mesh 66 through which air can flow; an air-permeable plug 68, for example comprising cellulose acetate fibres, is positioned adjacent to the mesh 66.

Figure 7:
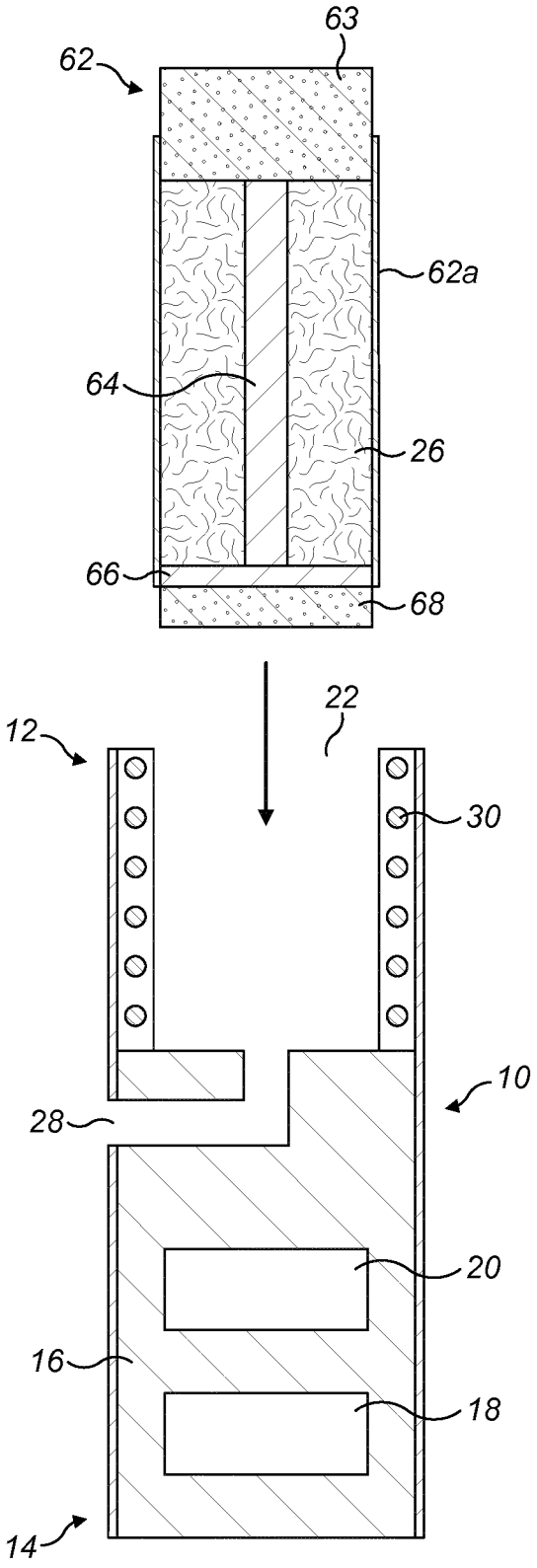
FIG. 7 is a diagrammatic view of an assembled aerosol generating article and inductively heatable elongate element of the kit of FIG. 6 ready for insertion into a heating compartment of an aerosol generating device.

The elongate element 64 and its associated metallic mesh 66 and air-permeable plug 68 is adapted for use individually with the plurality of aerosol generating articles 62 in the kit 60. As best seen in FIG. 7, the elongate element 64 is positioned by a user adjacent to the aerosol forming material 26 of an individual aerosol generating article 62 by pushing the elongate element 64 into the body of aerosol forming material 26 until it is fully inserted into the body. The assembled aerosol generating article 62 and elongate element 64 can then be inserted into the heating compartment 22 of the aerosol generating device 10 as denoted by the arrow in FIG. 7. Once inserted in the heating compartment 22, the aerosol generating device 10 is operated in the same manner described above with reference to FIG. 1. Thus, when the induction coil 30 is energised by the alternating high-frequency current, an alternating and time-varying electromagnetic field is produced. This couples with the inductively heatable susceptor material of the elongate element 64 and generates eddy currents and/or hysteresis losses in the inductively heatable susceptor material causing it to heat up. The heat is then transferred from the inductively heatable susceptor material to the body of aerosol forming material 26, for example by conduction, radiation and convection.

The heat transferred from the inductively heatable susceptor material of the elongate element 64 to the aerosol forming material 26 causes it to heat up and thereby produce an aerosol. The aerosolisation of the aerosol forming material 26 is facilitated by the addition of air from the surrounding environment through the air inlet 28 which flows through the air-permeable plug 68 and the metallic mesh 66 and through the aerosol forming material 26. The aerosol generated by heating the aerosol forming material 26 then exits through the air-permeable plug 63 which acts as a mouthpiece. It will be understood that the flow of air through the aerosol forming material 26 can be aided by negative pressure created by a user drawing air through the air-permeable plug 63.

After use of an individual one of the aerosol generating articles 62 with the aerosol generating device 10, the aerosol generating article 62 is removed from the device 10 by a user. Thereafter, the elongate element 64, along with its associated metallic mesh 66 and air-permeable plug 68, is separated from the aerosol generating article 62 and is used again in the same manner with the remaining aerosol generating articles 62 in the kit 60. Once all of the aerosol generating articles 62 in the kit have been used, the elongate element 64, along with its associated metallic mesh 66 and air-permeable plug 68, is discarded and a new kit 60 is used.

In some embodiments, the controller 20 may be configured to detect the number of aerosol generating articles 62 inserted into the heating compartment 22 and may be configured to cease power supply to the induction coil 30 until a replacement elongate element 64 is inserted into the heating compartment 22. For example, if the kit 60 contains twenty aerosol generating articles 62, the controller 20 could be configured to cease power supply to the induction coil 30 after the twenty aerosol generating articles 62, assembled with the same elongate element 64, have been inserted into the heating compartment 22.

The controller 20 could be configured to detect the use of a new elongate element 64, associated with a new kit 60, for example by detecting an identification characteristic associated with the elongate element 64. After detecting the use of a new elongate element 64, the controller 20 could be configured to detect a predetermined power level supplied to the induction coil 30 and to indicate a timing change of the elongate element 64 based on the detected power level and/or could be configured to detect the number of aerosol generating articles 62 inserted into the heating compartment 22 and to cease power supply to the induction coil 30 after a predetermined number of aerosol generating articles 62 have been inserted into the heating compartment 22.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating device for heating an aerosol generating article to generate an aerosol for inhalation by a user, the aerosol generating device comprising:
- an induction coil;
- a heating compartment arranged to receive the aerosol generating article; and
- a projecting element which projects into the heating compartment so that at least part of the projecting element is positioned inside an aerosol generating article received, in use, in the heating compartment;
- wherein the projecting element comprises a plurality of projecting elements which project into the heating compartment from opposite ends of the heating compartment,
- wherein at least part of the projecting element is inductively heatable, by the induction coil, in the presence of a time varying electromagnetic field, and
- wherein the projecting element is removably mounted on the aerosol generating device.

2. The aerosol generating device according to claim 1, wherein at least one of the plurality of projecting elements includes an air passage in communication with one or both of an air inlet and an air outlet of the aerosol generating device.

3. The aerosol generating device according to claim 1, wherein at least one of said plurality of projecting elements is arranged at a first end of the heating compartment on the mouthpiece and at least one of said plurality of projecting elements is arranged at a second end of the heating compartment on the device body.

4. The aerosol generating device according to claim 1, further comprising a device body including a controller.

5. The aerosol generating device according to claim 4, further comprising a mouthpiece removably mounted on the device body, wherein the mouthpiece includes at least one of the plurality of projecting elements.

6. The aerosol generating device according to claim 4, wherein at least one of the plurality of projecting elements is part of the device body.

7. The aerosol generating device according to claim 4, wherein at least one of the plurality of projecting elements is removably mounted on the device body.

8. The aerosol generating device according to claim 7, wherein the controller is configured to detect the mounting of at least one of the plurality of projecting elements on the device body.

9. The aerosol generating device according to claim 7, wherein the controller is configured to detect the placement of an aerosol generating article in the heating compartment.

10. An aerosol generating system for generating an aerosol for inhalation by a user, the aerosol generating system comprising:
- the aerosol generating device comprising:
  - an induction coil;
  - a heating compartment arranged to receive an aerosol generating article; and
  - a projecting element which projects into the heating compartment so that at least part of the projecting element is positioned inside an aerosol generating article received, in use, in the heating compartment;
  - wherein at least part of the projecting element is inductively heatable, by the induction coil, in the presence of a time varying electromagnetic field; and
- an aerosol generating article comprising a sealing member which is arranged to be broken by the projecting element during positioning of the aerosol generating article in the heating compartment.

11. The aerosol generating system according to claim 10, wherein the aerosol generating article comprises aerosol forming material defining a cavity in which the projecting element is positioned.

12. The aerosol generating system according to claim 11, wherein the projecting element is spaced from the aerosol forming material.

13. A kit of parts comprising:

a plurality of aerosol generating articles each comprising aerosol forming material; and an element at least part of which is inductively heatable in the presence of a time varying electromagnetic field and adapted for use individually with the plurality of aerosol generating articles by being positioned next to the aerosol forming material to heat the aerosol forming material to thereby generate an aerosol for inhalation by a user, wherein the element is adapted for removable mounting in an aerosol generating device, and wherein the element comprises an elongate element extending from a metallic mesh and an air-permeable glug positioned adjacent to the metallic mesh.

* * * * *